US006248289B1

(12) United States Patent
Schneider

(10) Patent No.: US 6,248,289 B1
(45) Date of Patent: Jun. 19, 2001

(54) CO-INJECTION MOLDING PROCESS FOR MANUFACTURING COMPLEX AND LIGHTWEIGHT PARTS

(75) Inventor: Jay lee Schneider, Canandaigua, NY (US)

(73) Assignee: Xerox Corporation, Rochester, NY (US)

( * ) Notice: Subject to any disclaimer, the term of this patent is extended or adjusted under 35 U.S.C. 154(b) by 0 days.

(21) Appl. No.: 09/602,744

(22) Filed: Jun. 23, 2000

(51) Int. Cl.[7] ..... B22F 7/00
(52) U.S. Cl. ..... 419/5; 264/610; 264/612
(58) Field of Search ..... 419/5, 37; 264/610, 264/612

(56) References Cited

U.S. PATENT DOCUMENTS 3,466,166 * 9/1969 Levinstein et al. ..... 75/0.5
3,528,809 * 9/1970 Redmond et al. ..... 75/222
3,734,723 * 5/1973 Blasch et al. ..... 75/214
3,804,617 * 4/1974 Conklin ..... 75/208 R
3,823,463 * 7/1974 Weaver et al. ..... 29/417
5,006,289 * 4/1991 Yamamoto et al. ..... 264/61
5,950,063 * 9/1999 Hens et al. ..... 419/5
5,989,473 * 11/1999 Haverty ..... 264/279

* cited by examiner

*Primary Examiner*—Daniel Jenkins
(74) *Attorney, Agent, or Firm*—Perman & Green, LLP

(57) ABSTRACT

A method for molding relatively complex and large shapes by a co-injection molding process which results in a significantly less expensive and lighter molded product. The process steps include first injection molding a thermoplastic material highly densified with ceramic or stainless steel particulate material to form a shell structure having a homogeneous dispersion of the ceramic or stainless steel material within its matrix and then injecting a significantly less expensive material into the core of the preformed thermoplastic/ceramic or stainless steel structure and thereafter sintering the resulting molded structure. The resultant structure is a hollow shell of highly densified ceramic or stainless steel.

13 Claims, 2 Drawing Sheets

CO-INJECTION MOLDING PROCESS FOR MANUFACTURING COMPLEX AND LIGHTWEIGHT PARTS

BACKGROUND OF THE INVENTION

1. Field of the Invention

This invention relates to an injection molding process and more particularly, this invention relates to a co-injection molding process for molding relatively complex and large shapes by a process that results in molded products having a lighter weight then heretofore produced, and molded product parts that are produced at a lower overall cost.

2. Description of the Prior Art

The co-injection molding process in comparison to the standard injection molding process offers the potential to reduce cost and improve quality of the part by using an overall simpler process for injection molding. At the same time the co-injection molding process permits one to produce relatively large and complex parts.

In the co-injection molding process a first material (such as first resin) is injected into a mold cavity, followed by, or simultaneously with, the injection with one or more other materials (e.g. a second resin) into the same cavity. This method typically results in the article having multiple layers across its cross-section and generally a greater number of layers than material types as in the case where sequential injection of the material is used.

The injection molding art includes the disclosure of many different apparatus and processes for forming molded articles from multiple resins by co-injection molding. For example, both U.S. Pat. Nos. 5,028,226 and 4,717,524 show simultaneous and sequential co-injection molding apparatus and processes respectively. Both patents show one nozzle dedicated to a mold cavity wherein the mold cavity is completely filled for molding purposes by injecting a multitude of resins through a single gate orifice.

An alternative co-injection molding process is shown in U.S. Pat. No. 4,803,031, where molded articles are formed by injecting one resin into a cavity and filling the cavity space, and thereafter enlarging the cavity and filling the additional space with a second resin. The result of such a technique is two distinct molded areas, each comprising a different resin type.

U.S. Pat. No. 3,873,656 illustrates a co-injection molding apparatus wherein a multitude of plastics are injected into a mold cavity through a number of different gates. The timing of the opening and closing of the gates dictates the amount and extent of the resin types which form the molded article. The design is basically suitable for molding very large plastic articles, wherein a multitude of gates can be used.

U.S. Pat. No. 5,173,736 describes a fuser apparatus for a printing machine wherein the fuser apparatus, i.e. a heated fuser roll has endcaps fitted to the opposing ends of the roll. The endcaps are disclosed as being made of aluminum (e.g. the roller member and the endcaps are a single piece).

U.S. Pat. No. 4,538,052 discloses a "prior art" fuser roller and an improvement thereof. The fuser roller comprises an aluminum roller member with stainless steel endcaps. Preferably the endcaps are fitted to the aluminum roller member under pressure using frictional heat.

U.S. Pat. No. 3,437,032 discloses a fuser roll which is similar to the above-mentioned prior art fuser roll in that stainless steel endcaps are shown secured to the ends of a nickel-plated copper tube. To avoid the technical difficulties in securing stainless steel to another metal, as well as the relatively high manufacturing costs associated with such a securing technique, U.S. Pat. No. 4,538,052 discloses an improved fuser roller in which a pair of bearings, having an outer portion made of heat-resistant resin, are fitted into end portions of the aluminum cylinder under pressure to support the cylinder so that the outer portion and cylinder turn as one unit. The heat-resistant resins are more economical than the metal members, and the outer portions of the roller can easily be fit into both end portions of the aluminum cylinder by merely pressing them against both end portions of the cylinder.

U.S. Pat. No. 5,980,245 discloses an endcap for a heated fuser roller which substantially reduces heat loss through the ends of the roller and is of sufficient strength and durability to transmit rotation to the rollers during extensive use. The endcap is molded from thermoplastic polymide filled with 20 to 50 weight percent glass fiber.

U.S. Pat. 5,649,891, discloses a composite endcap for a heated fuser roller which comprises a metal portion and a polymer portion. The endcaps are described as endcaps that substantially reduce heat loss through the end of the roller, and are of sufficient strength to support and transmit rotation to the roller.

In view of the current state of the prior art technology, there exists a need to have an injection molding process which can yield large and relatively complex parts at a significantly less expensive cost level than heretofore possible combined with producing an overall lighter weight part. A commercial part such as an end cap for a xerographic fuser roll fits into this category due to the high feedstock costs for metal injection molding such a part. In addition, most commercial parts made by injection molding processes are of a small size to minimize material usage.

Accordingly it is a primary advantage of this invention to provide a new and improved process for producing complex and large commercial parts which avoids all of the disadvantages outlined above. Other advantages of this invention are to employ a co-injection molding process for producing complex, large, lightweight and less expensive than heretofore possible commercial parts; and also to employ a co-injection molding process to produce end caps that can be employed in a xerographic fuser roll assembly. Additional advantages of the invention will be set forth in part in the description which follows, and some will be obvious from the description, or may be learned by practice of the invention in accordance with various features and combinations as particularly pointed out in the appended claims.

SUMMARY OF THE INVENTION

All of the foregoing advantages and others are attained by a method for molding relatively large and lightweight shapes by a co-injection molding process comprising (a) injecting a thermoplastic material densely dispersed with a ceramic or stainless steel particulate to form a shell structure having a homogeneous dispersion of said ceramic or stainless steel particulate material within said shell matrix; and (b) injecting into the core a low cost material capable of being vaporized at the sintering temperatures of said ceramic or stainless steel particulate material. Thereafter the resulting mold structure is sintered. After sintering there remains a molded structure of a hollow shell of highly densified ceramic or stainless steel.

BRIEF DESCRIPTION OF THE DRAWINGS

The accompanying drawings which are incorporated in and constitute a part of the specification illustrate one embodiment of the invention and, together with the following detailed description, serve to explain the principles of the present invention.

DETAILED DESCRIPTION OF THE INVENTION

While the invention will be described in connection with a preferred embodiment, it will be understood that it is not intended to limit the invention to that embodiment. On the contrary, it is intended to cover all alternatives, modifications and equivalents as may be included within the spirit and scope of the invention defined by the appended claims.

For a general understanding of some of the features of the present invention it is important to understand the type of environment that structural parts manufactured in accordance with the process defined by the present invention can be used. In that regard it will become evident that the process of the present invention can be equally well suited to manufacturing various parts for use in a wide variety of reprographic printing machines and is not necessarily limited in its application to the particular electrophotographic printing machine shown herein or the fuser assembly described below or even limited to a part for a electrophotographic printing machine.

Inasmuch as the art of electrophotographic printing is well know, the various processing stations employed in the FIG. 1 printing machine will be shown hereinafter schematically and their operation described briefly with reference thereto.

Figure 1:
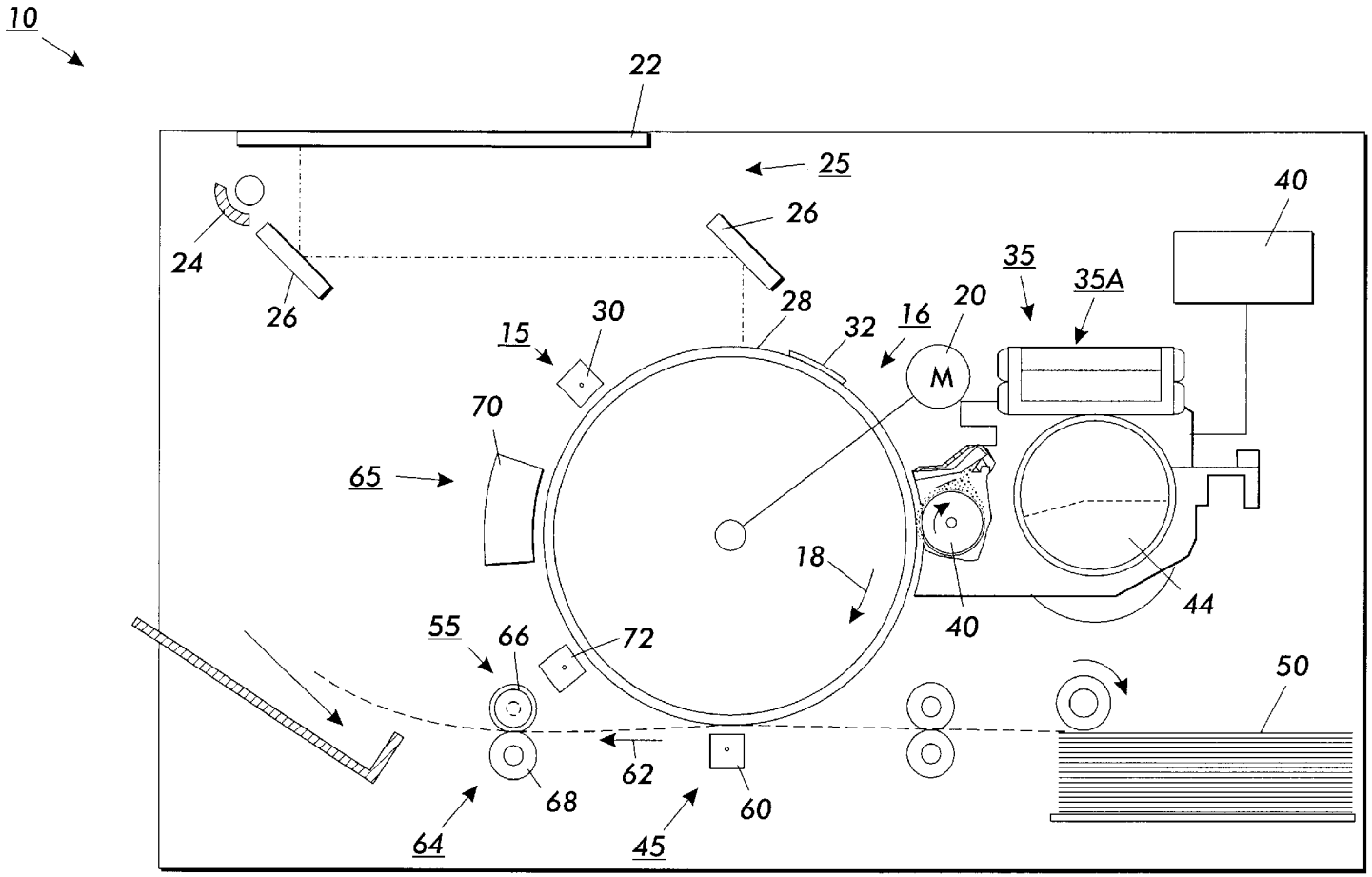
FIG. 1 is a partially schematic plan view of a reprographic printing apparatus employing parts made in accordance with the present invention.

Referring now to FIG. 1, the electrophotographic printing machine 10 shown employs a photoconductive drum 16, although photoreceptors in the form of a belt are also known, and may be substituted therefor. The drum 16 has a photoconductive surface deposited on a conductive substrate. Drum 16 moves in the direction of arrow 18 to advance successive portions thereof sequentially through the various processing stations disposed about the path of movement thereof. Motor 20 rotates drum 16 to advance drum 16 in the direction of arrow 18. Drum 16 is coupled to motor 20 by suitable means such as a drive mechanism. If a electrophotographic printer employs a photoconductive belt it is preferably made from a photoconductive material coated on a grounding layer, which, in turn, is coated on an anti-curl backing layer. The photoconductive material is made from a transport layer coated on a generator layer. The transport layer transports positive charges from the generator layer. An interface layer is coated on the grounding layer. The transport layer contains small molecules of di-m-tolydiphenylbiphenyldiamine dispersed in a polycarbonate. The generation layer is preferably made from trigonal selenium. The grounding layer is preferably made from titanium coated Mylar. The grounding layer is very thin and allows light to pass therethrough. Other suitable photoconductive materials, grounding layers, and anti-curl backing layers may also be employed.

Initially successive portions of drum 16 pass through charging station 15. At charging station 15, a corona generating device, indicated generally by the reference numeral 30, charges the drum 16 to a selectively high uniform electrical potential, preferably negative. Any suitable control, well known in the art, may be employed for controlling the corona generating device 30.

A document to be reproduced is placed on a platen 22, located at imaging station 25, where it is illuminated in a known manner by a light source such as a tungsten halogen lamp 24. The document thus exposed is imaged onto the drum 16 by a system of mirrors 26, as shown. The optical image selectively discharges surface 28 of the drum 16 in an image configuration to the document whereby an electrostatic latent image 32 of the original document is recorded on the drum 16 at imaging station 25.

At development station 35, a magnetic development system or unit, indicated generally by the reference numeral 30 advances developer materials into contact with the electrostatic latent images. Preferably, the magnetic developer unit includes a magnetic developer roll mounted in a housing. Thus, developer unit 35A contains a developer roll which advances toner particles into contact with the latent image. Appropriate developer biasing may be accomplished via power supply 40 electrically connected to developer unit 35A.

The developer unit 35A develops the charged image areas of the photoconductive surface. This developer unit contains magnetic black toner, for example, particles 44 which are charged by the electrostatic field existing between the photoconductive surface and the electrically biased developer roll in the developer unit. Power supply 42 electrically biases the developer roll.

A sheet of support material 50 is moved into contact with the toner image at transfer station 45. The sheet of support material is advanced to transfer station 45 by a suitable sheet feeding apparatus, not shown. Preferably, the sheet feeding apparatus includes a feed roll contacting the uppermost sheet of a stack of copy sheets. Feed rolls rotate so as to advance the uppermost sheet from the stack into a chute drum 16 in a timed sequence so that the toner powder image developed thereon contacts the advancing sheet of support material at transfer station 45.

Transfer station 45 includes a corona generating device 60 which sprays ions of a suitable polarity onto the backside of sheet 50. This attracts the toner powder image from the drum 16 to sheet 50. After transfer, the sheet continues to move, in the direction of arrow 62, onto a conveyor (not shown) which advances the sheet 50 to fusing station 55.

Fusing station 55 includes a fuser assembly, indicated generally by the reference numeral 64, which permanently affixes the transferred powder image to sheet 50. Preferably, fuser assembly 64 comprises a heated fuser roller 66 and a pressure roller 68. Sheet 50 passes between fuser roller 66 and pressure roller 68 with the toner powder image contacting fuser roller 66. In this manner, the toner powder image is permanently affixed to sheet 50. After fusing, a chute, not shown, guides the advancing sheet 50 to a catch tray, also not shown, for subsequent removal from the printing machine by the operator. It will also be understood that other post-fusing operations can be included. For example, stapling, binding, inverting and returning the sheet 50 for duplexing, and the like.

After the sheet 50 of support material is separated from the photoconductive surface of drum 16, the residual toner particles carried by image and the non-image areas on the photoconductive surface are charged to a suitable polarity and level by a preclean charging device 72 to enable removal therefrom. These particles are removed at cleaning station 65. The cleaner unit can include two brush rolls that rotate at relatively high speeds which create mechanical forces that tend to sweep the residual toner particles into an air stream (provided by a vacuum source), and then into a waste container. Subsequent to cleaning, a discharge lamp or corona generating device (not shown) dissipates any residual electrostatic charge remaining prior to the charging thereof for the next successive imaging cycle.

In accordance with the specific example described herein, fuser roll 66 can include endcaps (not shown) made by the co-injection molding process as described in accordance with the features of the present invention.

In general, a conventional fuser roll 66, as illustrated in FIG. 1, comprises; an aluminum cylinder; stainless steel members which are attached to both ends of the cylinder under pressure; and a heater inserted within the cylinder. Since the stainless steel members are attached to the cylinder under pressure, holes are cut in the attaching surfaces of the stainless steel member, and the aluminum cylinder is rubbed against the attaching surfaces. Since the aluminum is softened and melted by the frictional heat generated, this rubbing force causes the aluminum of the aluminum cylinder to enter the attaching holes. Due primarily to the nature of the metals employed the manufacturing cost of such a structure is high.

Figure 2:
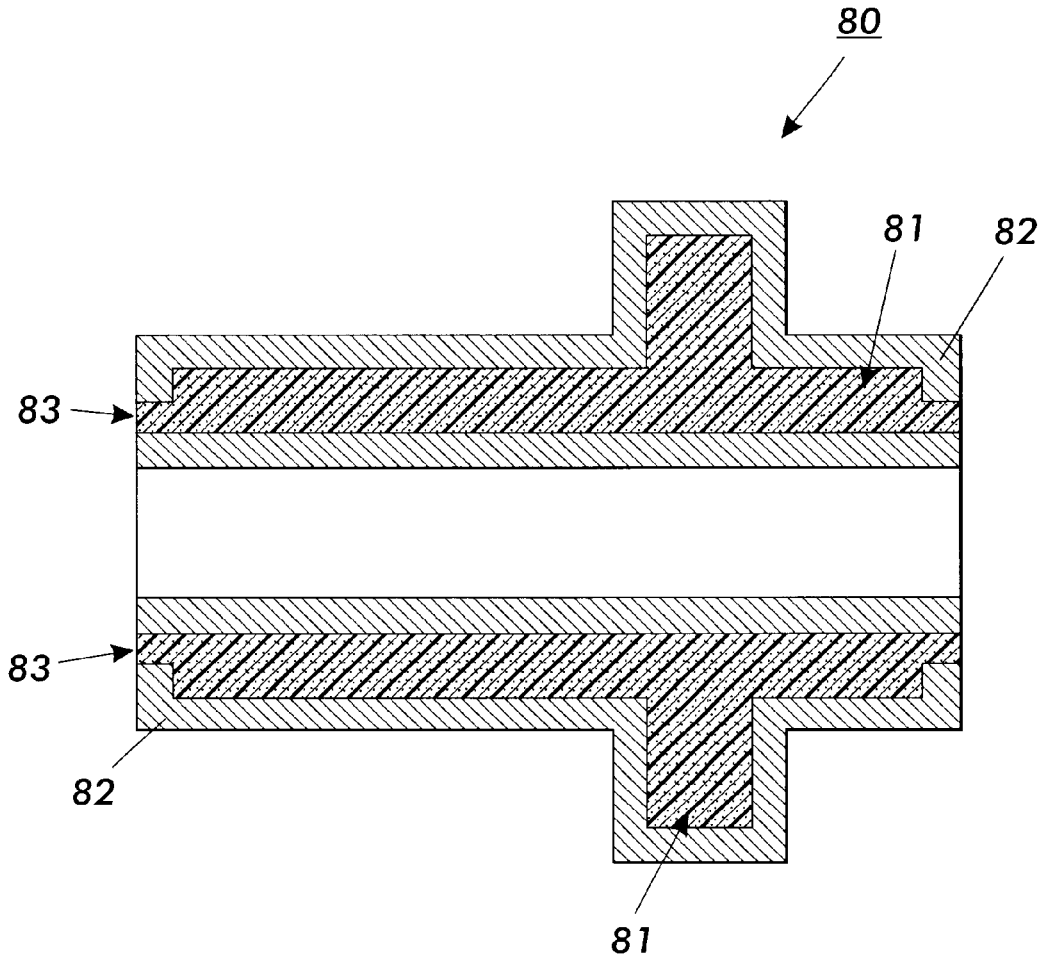
FIG. 2 is a cross sectional view of xerographic fuser end caps that have been co-injection molded in accordance with the process of the present invention.

The invention as described herein will now focus on the production of fuser end caps as used in a reprographic apparatus such as, for example a xerographic copier as generally shown in FIG. 2. However, it is to be understood that the co-injection molding method of this invention can be used for molding any complex shape where it is desired (1) to reduce manufacturing cost by employing less expensive materials than typically used in commercial injection molding processes; (2) produce significantly light-weight commercial parts; (3) employ a molding process wherein thermal conduction is reduced and (4) produce a part that is readily machinable.

The core of a xerographic fuser roll can be made of a high thermally conductive metallic material such as aluminum, and consists of a generally cylindrical wall having a desired thickness. For the endcaps 80 of the fuser as illustrated in FIG. 2, it has been generally found that austenitic stainless steel powder metal endcaps which are connected in a particular manner to the fuser core, (a) will last a relatively long time, (b) will exhibit relatively low thermal conductivity, (c) will have strength and stiffness characteristics that substantially match those of the aluminum core. However, the metal injection molded endcaps being a relatively large part becomes prohibitively expensive if, for example, stainless steel is used, especially due to the amount of material needed to mold the part. By using a co-injection molding process in the manner and with the materials as described herein, a much less expensive core material can be made while still retaining surface finish and material properties.

The present invention describes a process for molding relatively large and complex shapes by an innovative co-injection molding method. The first step in the process is to inject into a co-injection molding apparatus a thermoplastic material that is densely dispersed within a range of about 80% to about 83% by weight (e.g. 82% by weight) with a ceramic or stainless steel particulate to form a shell structure having a homogeneous dispersion of the ceramic or stainless steel particulate within the shell matrix. The thermoplastic material will act as a glue that will bind the ceramic or stainless steel material particles together. A co-injection molding apparatus such as a double gated molding cavity, i.e. a molding machine with two injection units can be used with the method of this invention.

Examples of the kind of ceramic material that could be used to form the shell 2 of the co-injection molded part 80 in accordance with the features of this invention include various ceramic powders, such as oxides, nitrides, carbides, and glass powders.

The thermoplastic portion can comprise any thermoplastic material mixture of thermoplastic materials that will eventually vaporize when the part is subject to sufficiently high temperature which occurs during sintering. Examples of suitable thermoplastic materials include materials such as thermoplastic polyimides, poly(amide-imides), poly(ether-imides), polyphthalamides, polyphenylene sulfides and polyketones.

Examples of commercially available materials that are useful in this invention include HT750.™. from Fiberite, Aurum.™. from Mitusi Co.; Torlon.™., Amodel.™., and Kadel.™. from Amoco; Ultem.™. from GE. Ryton.™. from Phillips; and Victrex.™. from ICI.

A preferred specific metal powder is austenitic stainless steel powder metal, because it exhibits relatively low thermal conductivity, and corrosion resistance; it can be molded to near net shape thereby requiring minimum machining; and it has appropriate strength and stiffness characteristics. Austenitic stainless steel can be defined as stainless steel composed principally of iron, nickel and chromium. Examples of austenitic stainless steels include AISI (American Iron and Steel Institute) type 303, 304, and 316 stainless steels. To increase the machinability of the metal portion, 1–5% by weight of molybdenum disulfide may be added to the austenitic steel powder. The powder metal can also be impregnated with a sealer so that cutting fluids do not enter the metal portion and for improved machinability. For a combination of maximum strength and minimum thermal conductivity, the stainless steel powder should be minus one hundred mesh (−100 mesh) to about +5 micron range in particle size.

The next step in the co-injection molding process in accordance with the features of the present invention is to inject mold into the core a low cost material capable of being vaporized during the subsequent sintering process. Examples of the kind of low cost material include polyethylene, polypropylene and polystyrene.

After injection molding the powdered metal based skin structure 82 over the core 81 the resulting co-injection mold structure is subject to a sintering process under such heating conditions (e.g. time and temperature) which of course depends to a large extent on the particular powder metal that is used for the metal skin. The object is to sinter until a solid and firm metal outer layer shell is achieved and the core material is vaporized and leaves via vent element 83. It has been found that sintering when the metal based material is stainless steel (especially an austenitic stainless steel) sintering is preferably done at a temperature is preferably done at a temperature ranging from about 2200° F. to about 2500° F. for about 24 to about 40 hours.

By using a less expensive material for the core structure 81, the amount of feed material required to mold a part is greatly reduced, making large metal injection molded parts made in accordance with the present invention economically viable. The metal shell material will impart all of the properties of a traditional metal injection molded part to the co-injection molded part, while reducing overall weight of the part and also reducing thermal conduction and allowing machining. If designed properly strength requirements will not be an issue.

In order to prevent blistering or cracking of the final part metal shell due to expansion of gasses in the core material, one or more vent-like structures 83 allow this expansion to occur without affecting the metal co-injection molded shell.

What is claimed is:

1. A method for molding relatively large and lightweight shapes by a co-injection molding process comprising:

(a) injecting a thermoplastic material densely dispersed with a ceramic or stainless steel particulate to form a shell structure having a homogeneous dispersion of said ceramic or stainless steel particulate material within said shell structure;

(b) injecting into the core portion of the mold a material capable of being vaporized at the temperature used to sintering said shell structure; and (c) sintering the resulting mold structure under such heating conditions to leave a solid metallic skin structure.

2. A method according to claim 1 wherein said ceramic is an oxide, nitride or carbide material.

3. A method according to claim 1 wherein the structure being molded is a xerographic end cap.

4. A method according to claim 1 wherein the density of said dispersion is about from 80% to about 83% by weight.

5. A method according to claim 1 wherein step (b) includes leaving at least one vent positioned at one end portion of said core mold, said vent adapted to allow for outgassing and expansion of said core mold.

6. A method according to claim 1 wherein said metal is stainless steel.

7. A method according to claim 1 wherein said metal based material is an austenitic stainless steel powder metal.

8. A method according to claim 7 wherein said mold structure is sintered at a temperature ranging from about 2200° F. to about 2500° F. for about 24 to about 40 hours.

9. A method for molding relatively large and lightweight shapes by a co-injection molding process comprising:

(a) injecting a thermoplastic material densely dispersed with a ceramic or stainless steel particulate to form a shell structure having a homogeneous dispersion of said ceramic or stainless steel particulate material within said shell structure; and (b) injecting into the core portion of the mold a material capable of being vaporized at the temperature used to sinter said shell structure.

10. A method according to claim 9 wherein said ceramic is an oxide, nitride or carbide material.

11. A method according to claim 9 wherein step (b) includes leaving at least one vent positioned at one end portion of said core mold, said vent adapted to allow for outgassing and expansion of said core mold.

12. A method according to claim 9 wherein said metal is stainless steel.

13. A method according to claim 9 wherein the density of said dispersion is about from 80% to about 83% by weight.

* * * * *